United States Patent [19]

Russell

[11] 4,287,141

[45] Sep. 1, 1981

[54] EMBANKMENTS CONSTRUCTION

[75] Inventor: Robert C. H. Russell, Wallingford, England

[73] Assignee: National Research Development Corporation, London, England

[21] Appl. No.: 34,916

[22] Filed: May 1, 1979

Related U.S. Application Data

[63] Continuation of Ser. No. 851,197, Nov. 14, 1977, abandoned.

[30] Foreign Application Priority Data

Nov. 22, 1976 [GB] United Kingdom ..... 48607/76

[51] Int. Cl.[3] ..... B28B 13/02

[52] U.S. Cl. ..... 264/33; 249/10; 264/34; 405/117; 425/62; 425/64

[58] Field of Search ..... 405/116, 117; 425/62, 425/64; 249/10; 264/33, 34

[56] References Cited

U.S. PATENT DOCUMENTS

| | | | |
|---|---|---|---|
| 2,652,695 | 9/1953 | Paulson | 405/117 |
| 3,429,130 | 2/1969 | Feiner | 405/116 |
| 3,474,626 | 10/1969 | Colle | 249/10 |
| 3,685,405 | 8/1972 | McDonald | 425/64 X |
| 4,090,363 | 5/1978 | List | 405/116 X |
| 4,152,382 | 5/1979 | Catenacci | 264/33 |

*Primary Examiner*—Thomas P. Pavelko

*Attorney, Agent, or Firm*—Cushman, Darby & Cushman

[57] ABSTRACT

An apparatus for forming embankments comprising a trapezium-shaped shield open at top and bottom and rearwardly. Material for the embankment is introduced into the top of the shield in slurry form and the difference in level between the slurry contained by the shield and the water outside the shield results in a force on the end wall of the shield. This causes the shield to travel end-wall first along the surface on which it is supported. As it moves forward, the shield will leave behind it an embankment formed to the same trapezium-shape as the shield itself. So that a layered form of embankment may be constructed, the shield may be fitted with a number of hoppers each associated with the formation of a particular layer.

15 Claims, 5 Drawing Figures

EMBANKMENTS CONSTRUCTION

This is a continuation of application Ser. No. 851,197 filed Nov. 14, 1977 now abandoned.

The present invention relates to embankment construction and more particularly, but not exclusively, to an apparatus for forming embankments partially immersed in water.

According to the present invention, an apparatus for forming embankments comprises a shield member having two side walls generally inclined towards each other in an upwards direction, and an end wall joining them with the bases of the end wall and the side walls lying substantially in a common plane. The end wall may be trapezium-shaped and/or dished.

In use, a slurry of particulate material, such as sand or gravel is pumped into the space between the shield and the unfinished embankment being formed by the shield and the difference in level between the contained slurry and water outside the shield results in a force on the end wall of the shield urging the shield to travel end-wall first along the surface on which it is supported.

Surplus water flows over a weir along the top of the shield. Means are provided for preventing the water, from which particles have separated, from flowing back along the embankment and eroding it. This may be accomplished by a shallow blade across the shield at its rear-end, extending from a few inches above the weir to a few inches below the top of the deposited material.

The end wall may, if desired, be slightly shorter than the side walls. In order that the shield shall move sufficiently slowly for the particulate material to drain and consolidate before the shield moves on, restraining means, conveniently in the form of cables attached to the shield, prevent or slow any forward movement of the shield of the sort above described. Differential control of the cables and other restraining means also provides the shield with a degree of steerage.

In a preferred embodiment of the invention, the shield carries at its rear end a hopper into which coarser particulate materials can be loaded for discharge on to the embankment core laid by the preceding part of the shield.

Conveniently two or more such hoppers can be included, e.g. for successively coarser grades of particulate material. Where it is desired to provide the embankment with an outer facing layer of precast slabs, then the shield conveniently carries at its rear end a means for laying the slabs on the core already laid by the preceding part of the shield. For example in one embodiment, for use with slabs with holes running between the ends (edge faces) of the slabs, the shield is provided with means for lowering on to the core formed by the preceding part of the shield a string of slabs threaded on cables extending through these holes.

Where it is desired to provide the embankment with an outer facing layer of precast slabs, then as an alternative to the hopper system outlined above, the shield may include means for laying on the embankment core a filter fabric on to which the slabs are subsequently laid by the slab laying means.

Where the embankment is to be formed in water and the supporting surface for the shield is inclined, it will normally be acceptable to have a shield capable of laying the greatest depth of embankment required (where the water is deepest) and then using only part of the shield's capacity in shallower regions by having the shield only partially full of slurry. In such cases, the end wall is preferably provided with an exhaust port or ports positioned above the supporting surface at a height variable to suit the depth of embankment being laid. For example, the end wall of the shield may include a vertically extending slot or slots the lower region(s) of which may be covered, up to the desired height, by slidable weir plates.

One drawback with this method of forming embankments is that the width of the top of the embankment will vary being greatest where the surrounding water is shallowest and less where the surrounding water is deeper. One solution for overcoming this drawback, though less attractive from a structural viewpoint would be to have the side and end walls of the shield upwardly and downwardly extensible so that the shield can be used to lay embankments of the same top dimensions but with varying heights and base dimension dependent on the downward extent of the shield walls.

To enable the shield to slide relatively easily along the supporting surface, the shield is conveniently provided with skids e.g. of a ski-like construction, arranged on either side of the shield externally of the shield walls.

Embodiments of the invention will now be described by way of example with reference to the accompanying schematic drawings in which.

The same reference numerals are used to indicate similar or identical parts in the various embodiments.

Figure 1:
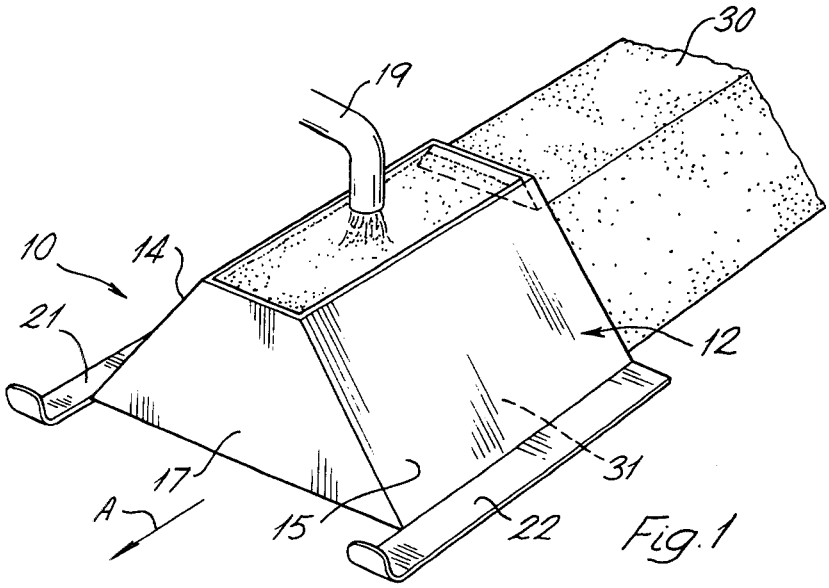
FIG. 1 is a perspective view, partly diagrammatic looking rearwards of a first embodiment of the invention.

Thus referring first to FIG. 1, an apparatus 10 for forming embankments comprises a shield member 12, having two similar rectangular side walls 14, 15 inclined towards each other in an upward direction and joined by a trapezium shaped end wall 17. Reference numeral 19 indicates a pipeline for pumping a sand/water slurry into the space enclosed by the shield and numerals 21, 22 indicate the skids on which the shield can slide in direction A.

A shallow blade 28 extends across the rear end of the shield to prevent the separated water content of the slurry from flowing back along the embankment 30 already laid by the shield and eroding it.

In operation, a sand/water slurry (in one example with a sand content of 23% by volume) is pumped into the shield and the greater depth of water within the shield (equal to the height of the top edges of the shield above the support surface) compared with that of the ambient water (not shown) in which the embankment is to be formed, provides a pressure differential across the end wall of the shield that results in a forwards force urging the shield along a growth axis in direction A as already described.

The forward movement of the shield is restrained (or prevented) by cables (18) (18) attached to the shield so that the sand content (31) has time to settle and consolidate and the water to drain by flowing over the shield weir before the settled and consolidated sand loses the support of the forwardly moving shield. When the embodiment of FIG. 1 is used, this embankment will normally be completed by depositing successive coarser layers of gravel on it usually followed by a final layer of boulders, for example using a conventional grab or the like.

Figure 2:
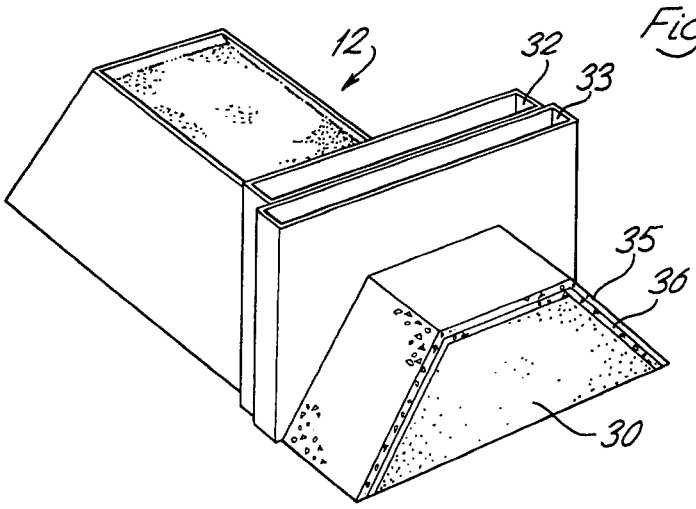
FIG. 2 is a similar view, but looking forwards, of a second embodiment of the invention.

In the embodiment of FIG. 2, on the other hand, the gravel is deposited by means of hoppers 32, 33, carried at the rear of the shield. The outlet ports of the two hoppers are spaced from the planes of the shield's side walls by amounts equal to the thicknesses of the layers 35, 36 to be deposited by the hoppers. Although only two such hoppers are shown, obviously any convenient number can be used.

Figure 3:
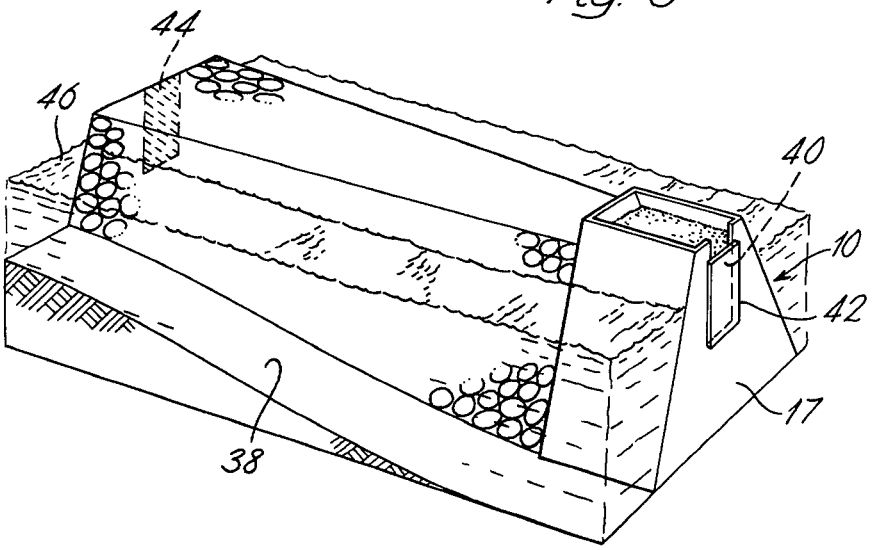
FIGS. 3 and 4 show details of optional features which can be included in either of these two embodiments.

FIG. 3 shows a perspective view of a shield 10 designed to cope with an inclined support surface 38. It will be seen that the end wall 17 of the shield has a downwardly extending slot 40 the lower portion of which is covered by a slidable weir plate 42 set so that the upper edge of the weir plate is always slightly below the top level of that portion of the embankment part currently under construction. The shaded rectangle identified by reference numeral 44 indicates the position of plate 42 at the beginning of the length of embankment shown in FIG. 3. Numeral 46 indicates the water in which the embankment is being built.

As an alternative procedure, it is of course always possible to dredge the support surface flat and then to use the embodiment of one of the earlier Figures.

Figure 4:
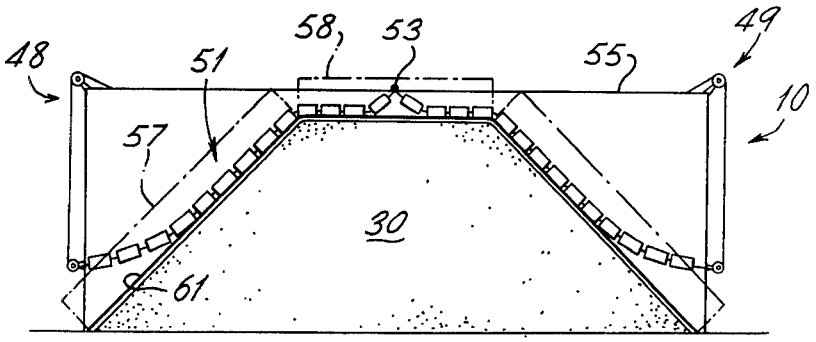

FIG. 4 shows an end view of a shield 10 utilising block and tackle systems 48, 49 to lay a final layer of slabs 51 at the outer covering of the embankment. The slabs, each of which has two holes extending between end faces of the slab, are threaded "at deck level" on a pair of cables secured at one end to a centre fixture 53 on a terminal portion 55 of the shield. At their other ends the cables are incorporated in the block and tackle systems 48, 49. When the shield has advanced by the width of a slab from the previously laid line of slabs, then the block and tackle systems are operated to lower the two strings of slabs on to the embankment core to complete the embankment. FIG. 4 shows an intermediate stage in this operation. The slabs may be grouted (using bitumen) if desired.

Where the slabs are to be laid on to gravel layers supported on the sand core, then the deck portion 55 of the shield may be preceded by the hopper system described in FIG. 2. Alternatively, where as is shown in FIG. 4, it is desired to lay the slabs on to a filter fabric supported directly on the sand core of the embankment, then conveniently the rear face of deck portion 55 carries rolls of the fabric (as indicated at 57, 58, 59). The fabric (61) is unrolled on to the embankment core as the shield progresses so that at any given moment the core is always covered by a layer of fabric on to which the slabs can be deposited.

Figure 5:
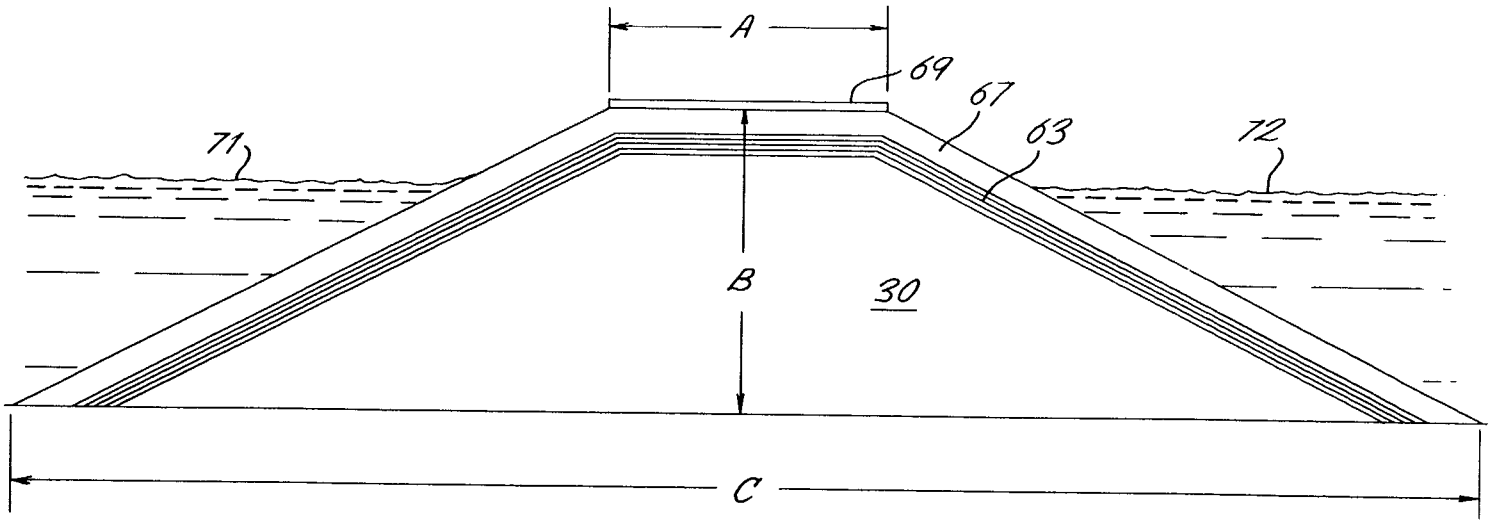
FIG. 5 shows a cross-section of what is envisaged will be a typical partially submerged embankment formed with the device of the invention.

FIG. 5 shows a typical embodiment made with an apparatus according to the present invention. In the illustrated case, dimension A is 15 feet, dimension B 20 feet, and dimension C 95 feet. The core 30 is formed of sand taken from the estuary or seabed and covered by a reverse filter 63 comprising successively coarser layers of grit, pea-gravel, coarse gravel and pebbles and finally, capped with armour rock. The embankment carries a road surface 69 on its top surface. Reference numerals 71, 72 indicate the water on either side of the embankment.

Where the embankment is to be used to contain large volumes of water, e.g. as a reservoir bund, then for reasons of mechanical stability it may be advantageous to have one side wall of the embankment inclined much less steeply than the other.

With conventional systems of constructing embankments in water, either boulder clay, gravel, or rock has been used or, where the circumstances have been favourable, very large amounts of sand slurry have been pumped into place until a sufficient quantity has remained for a long enough time for a more resistant layer of gravel etc. to be deposited on the core. As compared with the first of these two known systems, the apparatus of the present invention, by using a relatively cheap core material, sand, offers a saving in constructional costs. As compared with the second of the methods it offers a means of providing an embankment of accurately controlled dimensions in addition to a significant cost saving resulting from a more economic use of the core material.

Calculations indicate that a convenient rate of progress, 3 feet per hour, might be achievable with the cross-section shown in FIG. 5 if a concentrated slurry of sand in water (about 23% by volume of sand) is available at a flow of 4 cubic feet per second. Obviously this value does not include the time required to lay down any road surface to be carried on top of the embankment.

Where the embankment is to be formed in water and the supporting surface for the shield is inclined, it will normally be acceptable to have a shield capable of laying the greatest depth of embankment required (where the water is deepest) and then using only part of the shield's capacity in shallower regions by having the shield only partially full of slurry. In such cases, the end wall is preferably provided with an exhaust port or ports positioned above the supporting surface at a height variable to suit the depth of embankment being laid. For example, the end wall of the shield may include a vertically extending slot or slots, the lower region of which may be covered, up to the desired height, by slidable weir plates. In this method of forming embankments the width of the top of the embankment will vary being greatest where the surrounding water is shallowest and being less where the surrounding water is deeper. One way of overcoming this variation is to have the side and end walls of the shield upwardly and/or downwardly extendable, as indicated respectively by the dotted lines 19', 19'' in FIG. 1. By this modification the shields can be adjusted to lay embankments with the same top dimensions but with varying heights and base dimensions dependent on the downward extent of the shield walls.

I claim:

1. A method for constructing an embankment member or the like out of sand, comprising:

providing resting upon a surface a closed sided, closed front ended, open bottomed and open rear-ended moulding shield trailed by a doctor blade for together defining the required profile and top surface of the embankment member;

gradually moving the shield forwards on said surface along a path while filling and continuing to fill the shield with a water/sand slurry up to the effective upper extent of said closed front end, this movement being controlled to be so gradual that by the time the shield has moved forwards sufficiently to expose each new lengthwise increment of embankment member beyond said shield rear end, said each new increment has become constituted by wet sand that has settled out of said slurry up to the lower extent of said doctor blade.

2. The method of claim 1, further comprising:

progressively unrolling onto said embankment member from said shield astern thereof a layer of filter fabric so as to cover the top surface and flanks of said embankment member with said filter fabric;

progressively assembling a network of flexibly interconnected slabs on said shield, near the rear end thereof, and progressively lowering succeeding quanta of this network onto the filter fabric-coated embankment member.

3. The method of claim 1, wherein:

said surface exists as a submerged surface in a body of water, throughout at least a portion of said path, throughout the conducting of said gradually moving and filling and continuing to fill steps, so that said embankment member upon completion by one path traversal, at least as to one flank thereof, provides a barrier against movement of water of said body of water transversally therepast.

4. The method of claim 1, further comprising:

strewing at least one layer of coarse aggregate upon said embankment member from said shield, from behind said doctor blade.

5. The method of claim 4, further comprising:

progressively assembling a network of flexibly interconnected slabs on said shield, near the rear end thereof, and progressively lowering succeeding quanta of this network onto the aggregate-coated embankment member.

6. A method of constructing, on a supporting surface above or below water, a water-retaining structure in the form of an embankment or the like using particulate material delivered hydraulically in a liquid medium to the intended position of the structure, the method including:

providing a movable form having an exit with a cross-section shape substantially the required finished profile of a desired water-retaining structure, an entry for hydraulically-delivered particulate material, and a thrust surface for action by said particulate material and said liquid in the form, together with a supply of such particulate material and a supply of said liquid delivery medium;

positioning the form, said exit to the rear, on a growth axis of the desired water-retaining structure;

hydraulically delivering particulate material from said supply thereof into said form entry to charge the form and to exert a thrust on said thrust surface to urge the form forward along said axis;

restraining the form to move under forward urgence of said thrust only so fast as to be accompanied by at least partial drainage of said liquid delivery medium from said particulate material in said form before said movement becomes accompanied by emergence of said at least partly-drained particulate material from said exit in said water-retaining structure profile; and thereafter continuing the hydraulic delivery and restraint to construct said water-retaining structure along said growth axis.

7. A method for constructing an embankment upon a surface, comprising:

providing a shield having two opposed side walls which slope upwards toward one another, an upward forward end wall joining the two side walls, and a trailing rear end wall joining the two side walls in a required embankment profile, with the side walls and forward end wall extending downwards to the level of what is to be the base of the embankment and upwards at least to the level of what is to be the top surface of a core portion of the embankment and the rear end wall extending downwards to the level of what is to be the top surface of said core portion so that the upper edges of the side walls and end walls frame an upwardly open mouth for the shield;

determining a two-ended growth axis along which said embankment is to be formed and placing said shield so that it is movably supported upon said surface at one end of said growth axis, forward end wall forwards, for movement along said growth axis to the other end thereof;

forming a hydraulic mixture of water and solid particulate material and pumping that mixture into said shield through said upwardly open mouth at such a rate that the shield becomes and remains full of said mixture, with the solid particulate material settling out of said mixture within said shield and the water tending to flow out of said shield so that said shield gradually becomes full of wet, but settled-out solid particulate material;

while continuing to perform said forming and pumping steps, guiding movement of said shield gradually forwards along said growth axis to said opposite end thereof, so that more room for said mixture within said shield is incrementally being made immediately to the rear of said forward end wall, until said opposite end is reached, the speed at which said shield so moves being controlled to assure that at each point along said growth axis the level of wet, but settled-out particulate material reaches at least up to the lower edge of said trailing rear wall before said lower edge passes such point, so that said lower edge acts as a doctor blade for the top surface of said core portion of the embankment.

8. The method of claim 7, wherein:

said mixture is constituted by making a mixture of water and sand.

9. The method of claim 7, wherein:

said pumping is carried out with such force and rate as to cause said shield to tend to travel forwards faster than said speed; and said guiding is constituted by constraining and restraining said shield so as to avoid exceeding said speed and so as to prevent deviation of said shield from travelling along said growth axis.

10. The method of claim 9, wherein:

the step of placing said shield so that it is movably supported upon said surface is constituted by resting said shield upon skids oriented to permit the shield to slip forwards along said growth axis.

11. The method of claim 7, further including:

adjusting the effective upper extent of at least a portion of said shield mouth in the vicinity of where said more room is being made during said gradual forwards movement, for controlling the height to which said wet particulate material may settle out in said vicinity.

12. The method of claim 11, wherein:

said adjusting step is carried out as said shield is moving gradually forwards upon a said surface which is sloping longitudinally of said growth axis.

13. The method of claim 7, further including:

after points along said embankment core being formed have been passed by said rear wall due to said gradual forward movement of said shield, covering said top surface and the resulting sloping opposite flanks of said embankment core with at least one layer of coarser solid particulate material than said solid particulate material of said mixture.

14. The method of claim 13, wherein:

said covering is accomplished by providing said shield with at least one hopper for said coarser solid particulate material trailing said rear end wall, said at least one hopper having an effective lower extent that is at a higher level than that of said shield rear end wall, and said coarser solid particulate material being trailed onto said embankment core from said at least one hopper as said shield moves gradually forwards.

15. The method of claim 14, wherein:

there is a succession of two such hoppers, the second having an effective lower extent that is at a higher level than that of the first and the second being provided with a supply of coarser solid particulate material that is even coarser than a supply of coarser solid particulate material that is provided to the first such hopper, so that as said shield moves along, the gradually emerging core of wet, settled particulate material is successively covered with two layers of increasingly coarse particulate material.

* * * * *